US011781316B1

(12) United States Patent
Okeeffe

(10) Patent No.: US 11,781,316 B1
(45) Date of Patent: Oct. 10, 2023

(54) FRAMING DEVICE FOR A FIRE-RATED GLASS FLOOR

(71) Applicant: William F. Okeeffe, Brisbane, CA (US)

(72) Inventor: William F. Okeeffe, Brisbane, CA (US)

(73) Assignee: O'KEEFFE'S, INC., Brisbane, CA (US)

( * ) Notice: Subject to any disclaimer, the term of this patent is extended or adjusted under 35 U.S.C. 154(b) by 7 days.

(21) Appl. No.: 16/988,490

(22) Filed: Aug. 7, 2020

(51) Int. Cl.
*E04B 5/02* (2006.01)
*E04B 1/61* (2006.01)
*E04B 5/46* (2006.01)

(52) U.S. Cl.
CPC ..... *E04B 5/023* (2013.01); *E04B 1/61* (2013.01); *E04B 5/46* (2013.01); *E04B 2103/02* (2013.01)

(58) Field of Classification Search
CPC ... E04B 5/023; E04B 5/46; E04B 1/61; E04B 2103/02
USPC ..... 52/126.5
See application file for complete search history.

(56) References Cited

U.S. PATENT DOCUMENTS

RE16,416 E * 9/1926 Whitaker ..... E04B 5/12 52/126.5
3,251,163 A * 5/1966 Russell ..... E04B 1/14 52/584.1
4,063,395 A * 12/1977 Stewart ..... E04D 3/351 220/900
4,250,674 A * 2/1981 Feist ..... E04B 5/48 D25/138
4,546,581 A * 10/1985 Gustafson ..... E02D 27/34 52/126.6
4,788,809 A * 12/1988 Koukourou ..... E04B 5/326 52/741.15
4,841,704 A * 6/1989 Jarrell ..... E01C 11/106 52/396.02
5,800,094 A * 9/1998 Jones ..... E02D 35/00 254/133 R
5,901,523 A * 5/1999 Tasi ..... A47B 57/54 52/653.2
6,023,899 A * 2/2000 Mecozzi ..... E04B 1/617 52/794.1
6,202,383 B1 * 3/2001 Reiter ..... E04F 11/1812 52/770
6,367,764 B1 * 4/2002 Butler ..... E02D 27/00 411/397
6,449,914 B1 * 9/2002 Horstketter ..... E01D 19/125 52/459
6,814,524 B1 * 11/2004 Peterson ..... E02D 35/00 405/229

(Continued)

FOREIGN PATENT DOCUMENTS

CN 1484726 A * 3/2004 ..... E04B 1/08
DE 3900594 A1 * 1/1990 ..... E04B 1/043

(Continued)

*Primary Examiner* — Brian D Mattei
*Assistant Examiner* — Joseph J. Sadlon
(74) *Attorney, Agent, or Firm* — Theodore J. Bielen, Jr.

(57) ABSTRACT

A framing device for a glass floor unit utilizing a shield connected to the glass floor unit and at least one tab connected to the shield. A threaded member selectively interacts with the tab to adjust the vertical position of the glass floor and to hold down the glass floor relative to a support connected to an edifice foundation.

9 Claims, 11 Drawing Sheets

(56) References Cited

U.S. PATENT DOCUMENTS 7,980,042 B2 * 7/2011 Polk, Jr. ..... B29C 51/20 52/587.1
8,011,153 B2 * 9/2011 Orchard ..... E04F 15/02 52/489.1
8,136,310 B2 * 3/2012 Tweedie ..... F24S 25/30 52/173.3
8,256,172 B2 * 9/2012 Benson ..... E04F 11/035 52/220.1
8,590,224 B2 * 11/2013 Rummens ..... H01L 31/048 52/173.3
8,991,065 B1 * 3/2015 Schrock ..... F24S 25/632 33/679.1
9,068,347 B2 * 6/2015 Moeller ..... B32B 17/10311
9,284,729 B2 * 3/2016 Von Hoyningen Huene ..... E04B 2/7453
9,347,232 B1 * 5/2016 Francies, III ..... E04B 5/04
9,359,766 B2 * 6/2016 Shiao ..... E04D 5/10
9,712,106 B2 * 7/2017 Wentworth ..... F24S 25/61
9,926,709 B1 * 3/2018 O'Keeffe ..... B32B 17/10311
10,156,065 B2 * 12/2018 Vanker ..... E04B 1/40
10,233,652 B1 * 3/2019 Hogan ..... F24S 25/35 52/173.3
10,511,251 B2 * 12/2019 Kobayashi ..... F24S 25/632
10,763,777 B2 * 9/2020 Stearns ..... E04D 13/10
11,339,563 B2 * 5/2022 Brodowski ..... E01D 19/125
2011/0302857 A1 * 12/2011 McClellan ..... F24S 25/35 52/173.3
2012/0144760 A1 * 6/2012 Schaefer ..... F24S 25/20 248/237
2014/0041321 A1 * 2/2014 Poivet ..... H01L 31/0521 52/173.3
2021/0115676 A1 * 4/2021 Rae ..... E04F 15/08

FOREIGN PATENT DOCUMENTS

DE 9307863 U1 * 7/1993 ..... E04G 21/18
FR 2723123 A1 * 2/1996 ..... E04B 1/94
FR 3006698 A1 * 12/2014 ..... B32B 17/069

* cited by examiner

FRAMING DEVICE FOR A FIRE-RATED GLASS FLOOR

CROSS-REFERENCE TO RELATED APPLICATION

The present application is a continuation-in-part of U.S. patent application Ser. No. 16/362,438, filed 22 Mar. 2019.

BACKGROUND OF THE INVENTION

The present application relates to a novel and useful glass floor system which may be installed in building structures.

Glass floor structures have been used in the past in substitution for conventional floor units in edifices. Typically, glass floors are constructed in two parts. The upper part normally consists of a durable or structural glass layer, which may take the form of laminated, tempered glass plates. Such structural glass also provides a walking surface for the floor of the building base. A fire-rated glass portion is also placed below the durable structural glass layer and is either connected to the durable glass layer or separated from the same. The fire-rated glass unit typically provides fire protection below the glass floor unit.

In the past, many glass floor systems have been proposed. For example, French patent FR2723123 and U.S. Pat. No. 7,694,475 depict such structures.

U.S. Pat. No. 9,925,709 discloses a significant improvement to such prior art systems by the addition of a post-installation adjustment mechanism to determine the level of the glass floor system in relation to the construction parameters of the building in which the glass floor system has been installed.

Glass floor units, although aesthetically pleasing and compatible with existing structures, often suffer damage prior to installation, during shipping and transport, as well as damage due to traffic on the walking surface, as a result of moving objects and/or vehicles such as skateboards, scooters, and the like.

A glass floor apparatus which is able to resist destructive forces during shipment and after installation would be a notable advance in the construction arts.

SUMMARY OF THE INVENTION

In accordance with the present application, a novel and useful framing device for a glass floor structure is herein provided.

The device of the present application utilizes a glass floor unit consisting of a durable or structural glass floor portion having a walking surface, which is connected to a fire-rated glass portion below the walking surface. The durable glass portion is formed with an undersurface and a side surface in addition to the walking surface.

The glass floor unit is also assembled with a support that is positioned to exert a force on the glass floor unit. The support is linked to a bearing foundation, which is a conventional structure provided by the building itself.

The device of the present application also includes a shield which is provided with a first part that extends over the walking surface of the durable glass portion and a second part that overlies the side surface of the durable glass portion. The shield further includes a third part that forms a pocket for at least partially encompassing the support holding the glass floor unit to the foundation. The shield affords overall impact and abrasion protection to the glass floor unit.

In certain cases, the support may take the form of a plate that lies within the pocket formed within the third part of the shield. In this regard, the shield may take the form of a metallic member and serves to aid in the transfer of loading or any seismic uplift or other forces below the fire-rated glass unit. Such forces may include explosions or bomb blasts.

Where glass floor units are placed adjacent one another to form a large glass floor, shields may be used on multiple glass floor units. In the case of two adjacent glass floor units, the third portions of adjacent shields each form a pocket that encompasses a common support or such common support in the form of a plate, as hereinabove described. The shields of the present application are fully compatible with the adjustment mechanism found in U.S. Pat. No. 9,926,709, hereinabove described.

It may be apparent that a novel and useful framing device for a glass floor structure has been hereinabove described.

It is therefore an object of the present application to provide a framing device for a glass floor structure that aids in the prevention of damage to the glass floor structure during transportation to the building site.

Another object of the present application is to provide a framing device for a glass floor structure that resists damage to the glass floor structure after installation due to walking traffic, as well as moving devices such as carts, scooters, skateboards, and the like.

Another object of the present application is to provide a framing device for a glass floor structure that aids in the transfer of gravitational loading and for other extraneous uplift forces.

Another object of the present application is to provide a framing device for a glass floor structure that is fully compatible with any adjustment mechanisms employed with a particular glass floor unit.

Another object of the present application is to provide a framing device for a glass floor structure that provides a groove or pocket that is usable with adjustment mechanisms known in the prior art.

Another object of the present application is to provide a framing device for a glass floor unit that includes a shield over glass surface portions of the glass floor unit as protection against damaging forces, which may be encountered prior to or after installation of the glass floor unit.

Yet another object of the present application is to provide a shield for a glass floor unit formed of a fire-rated glass layer overlain and connected to a structural glass layer.

The application possesses other objects and advantages especially as concerns particular characteristics and features thereof which will become apparent as the specification continues.

For a better understanding of the application, reference is made to the following detailed description of the preferred embodiments thereof which should be referenced to the prior described drawings.

DETAILED DESCRIPTION OF THE PREFERRED EMBODIMENTS

Various aspects of the present application will evolve from the following detailed description of the preferred embodiments thereof which should be referenced to the prior delineated drawings.

Figure 1:
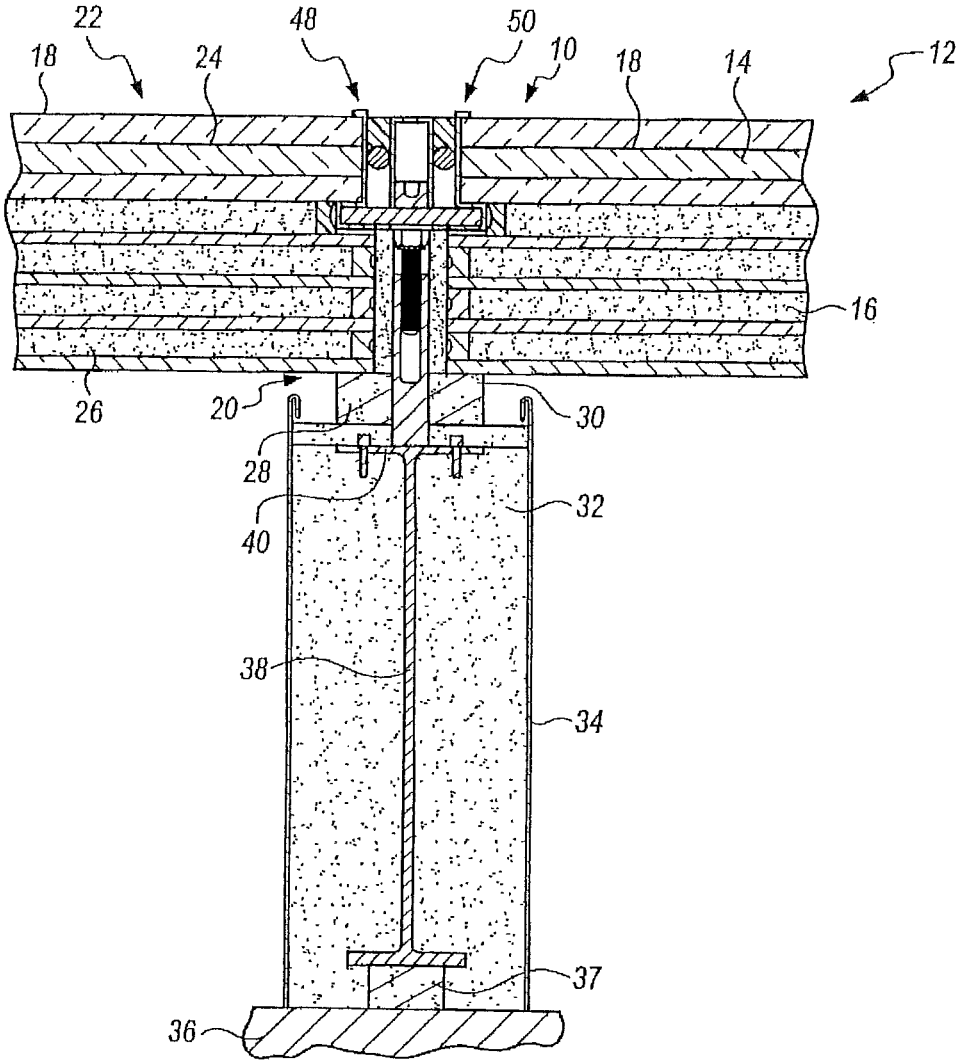
FIG. 1 is a sectional view showing a pair of glass floor units installed above a foundation utilizing the framing device of the present application.

The invention as a whole is depicted in the drawings by reference character 10. Framing device 10 is depicted in FIG. 1 as being part of a glass floor unit 12. Glass floor unit 12 is fashioned with a durable or structural glass, upper portion 14, and a lower fire-rated glass portion 16. Structural glass portion 14 may comprise multiple layers of tempered glass that are laminated to one another. As such, a walking surface 18 is provided that is exposed to traffic of various sorts. For example, in addition to ambulatory traffic, walking surface 18 is typically used for carts, rolling furniture, skateboards, scooters, and the like. As shown in FIG. 1, glass floor unit is employed with a support 20 which may include an adjuster 21 to raise and lower glass floor units 12, as well as an adjacent glass floor unit 22 having structural glass portion 24 and fire-rated glass portion 26. Adjuster 21 is described in U.S. Pat. No. 9,926,709. Walking surface 18 is indicated in the drawing to extend across both glass units 12 and 22. It should be noted that fire-rated glass portions 16 and 26 of glass floor units 12 and 22, respectively, may be in the form of a glass panel identified as Superlite-II-XLF, which is available from SaftiFirst of Brisbane, Calif. Glass floor units 12 and 22 sit atop gypsum boards 28 and 30, which in turn lie atop concrete post 32. Closure 34 encases and serves as a form for the pouring of concrete post 32 positioned on foundation or base 36. Beam 38 within concrete post 32 is typically attached to foundation or base 36, which may be embodied as a building support such as a wall, a bracket attached to a wall, and the like. Gypsum board block 37 is glued to beam 38 prior to the pouring of concrete post 32. Beam 38 within concrete post 32 extends upwardly to a flange 40 beneath gypsum boards 28 and 30.

Figure 2:
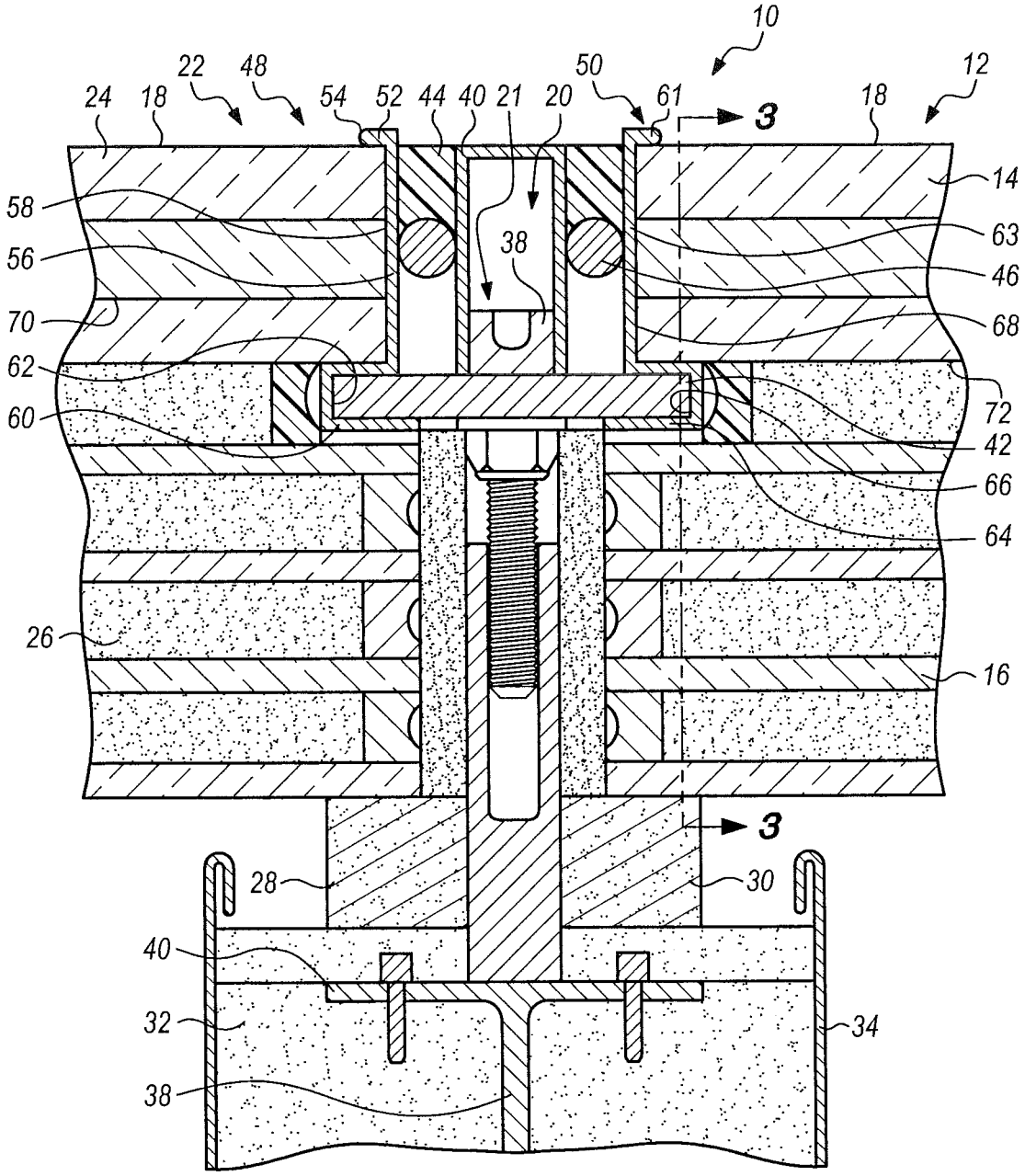
FIG. 2 is an enlarged partial sectional view of FIG. 1 amplifying the framing device of the present application in use on a pair of glass floor units.

Turning to FIG. 2, it may be observed that device 10 is more clearly depicted. Support 20 is depicted as including an adjustment bolt 38 of adjuster 21 positioned within channel 40 and a plate 42 which is capable of moving upwardly and downwardly to adjust the position of glass floor units 12 and 22. Seals 44 and 46 lie adjacent channel 40. A pair of shields 48 and 50 are used to protect glass floor units 12 and 22 against damaging forces. With respect to shield 48, a first part 52 thereof extends over walking surface 18 of glass floor unit 22. First part 52 is relatively narrow in width, extending 1.5 cm or less in height above walking surface 18. First part 52 is also formed with a relieved edge portion 54 which may take the form of a chamfered, beveled, rounded, or like configuration. Shield 48 also is formed with a second part 56 that overlies side surface 58 of glass floor unit 22. A third part 60 of shield 48 assumes a U-shaped configuration and forms a pocket 62 which at least partially encompasses a plate 42 of support 20. It should be realized that the structure of shield 50 with respect to glass floor unit 12 possesses the same structure and is illustrated in FIG. 2 as being a mirror image of shield 48. Needless to say, shield 50 also possesses a third part 64 that forms a pocket 66 to at least partially encompass plate 42 of support 20. In this manner, the walking surface 18 of glass units 12 and 22 are protected against damage, especially at the corners thereof from traffic on walking surface 18. Also, side surface 58 of glass floor unit 22 and side surface 68 of floor unit 12 are protected by second parts 56 and 63, respectively, which is especially useful during transport and positioning of glass floor units 12 and 22. It should also be noted that the undersurface 70 of glass floor unit 22 and the undersurface 72 of glass floor unit 12 are overlain by third part 64 of shield 50 and third part 60 of shield 48, respectively. This positioning of third parts 64 and 60 of shields 50 and 48 aids device 10 in the transferring of load from uplift forces that may occur due to seismic events, bomb blasts, and the like below fire-rated glass portions 16 and 26.

Figure 3:
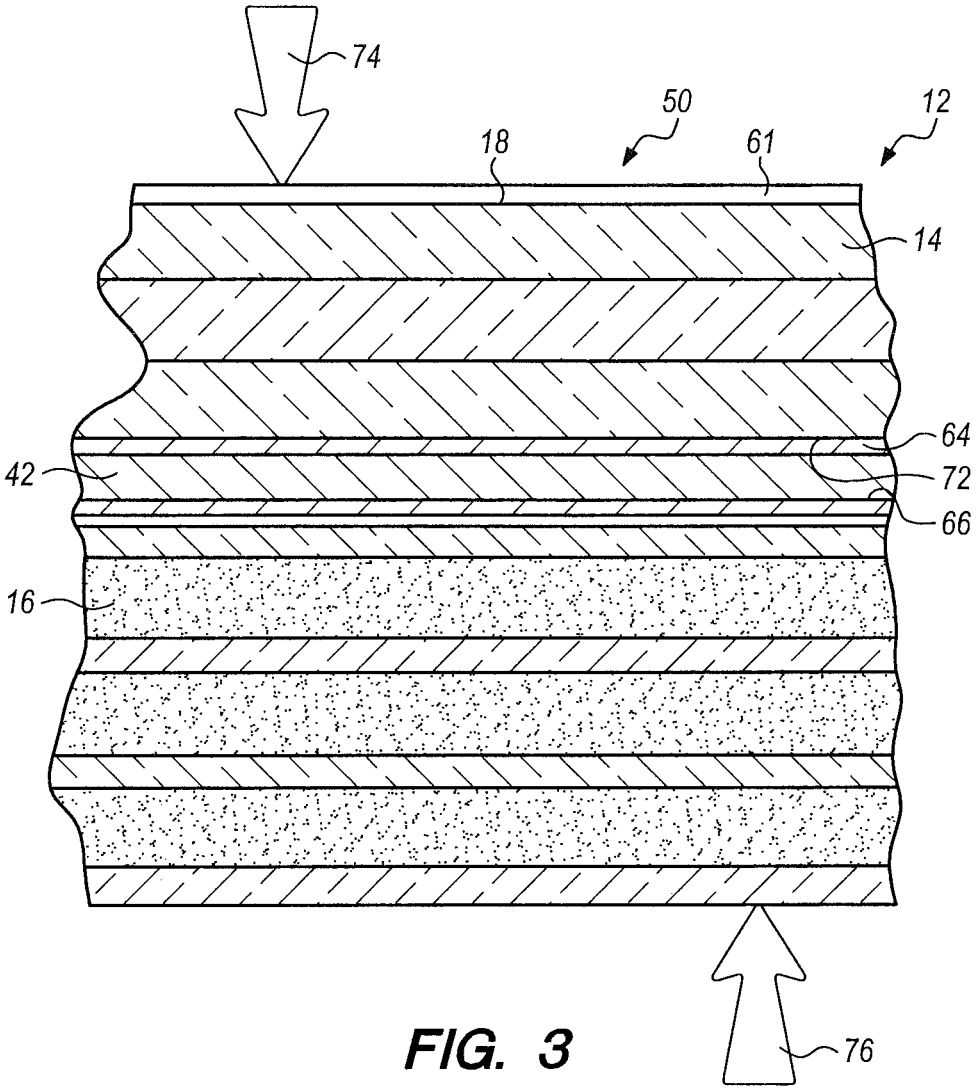
FIG. 3 is a sectional view taken along line 3-3 of FIG. 2.

FIG. 3 shows the relative positioning of the heretofore described elements of device 10. It should also be realized that directional arrows 74 and 76 represent the forces exerted by traffic on walking surface 18 and the lift force exerted on device 10 by bomb blast, seismic, or other environmental reacting forces, respectively.

Figure 4:
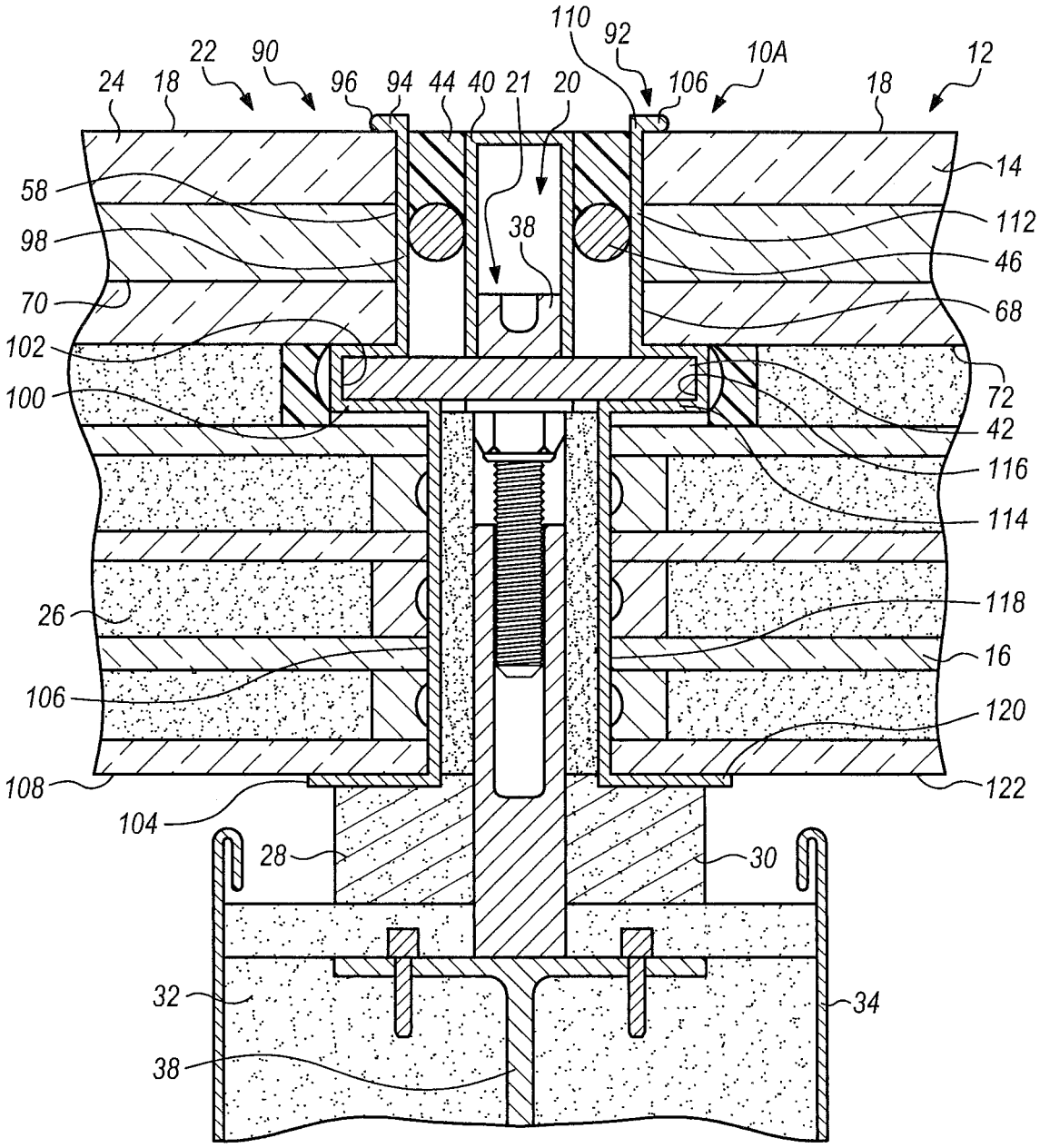
FIG. 4 is a sectional view of another embodiment of a framing device for a glass floor unit.

With reference to FIG. 4, another embodiment 10A of the device of the present application is depicted. Common elements to device 10 of FIGS. 1 and 2 retain reference characters in FIG. 4. Device 10A is formed with shields 90 and 92 that are protecting glass floor units 12 and 22. Shield 90 may be formed of any rigid or semi rigid material such as stainless steel, copper, and the like. Shield 90 possesses a first part 94 that extends over walking surface 18 of glass floor unit 22. First part 94 is similar to first part 52 of shield 48 of FIGS. 1 and 2, and extends 1.5 cm or less in height above walking surface 18. First part 94 is also fashioned with a relieved edge portion 96 which may be chamfered, leveled, rounded, or the like. Shield 90 is also constructed with a second part 98 overlying side surface 58 of glass floor unit 22. Third part 100 of shield 90 takes a U-shaped or concave form to create a pocket 102, which at least partially encompasses plate 42 of support 20.

Shield 90 also comprises a fourth part 104 that overlies and protects side 106 of fire-rated glass portion 26, as well as underside 108, thereof.

Shield 92, a mirror image of shield 90 has a first part 110 with a relieved edge 106 atop walking surface 18. Shield 92 further includes a second part 112 overlying side surface 68 of durable structural glass 14 and a third part 114 defining a pocket 116, at least partially encompassing plate 42 of support 20. Lastly, shield 92 is further configured with a fourth part 118 overlying and protecting side 120 and underside 122 of fire-rated glass portion 16.

Figure 5:
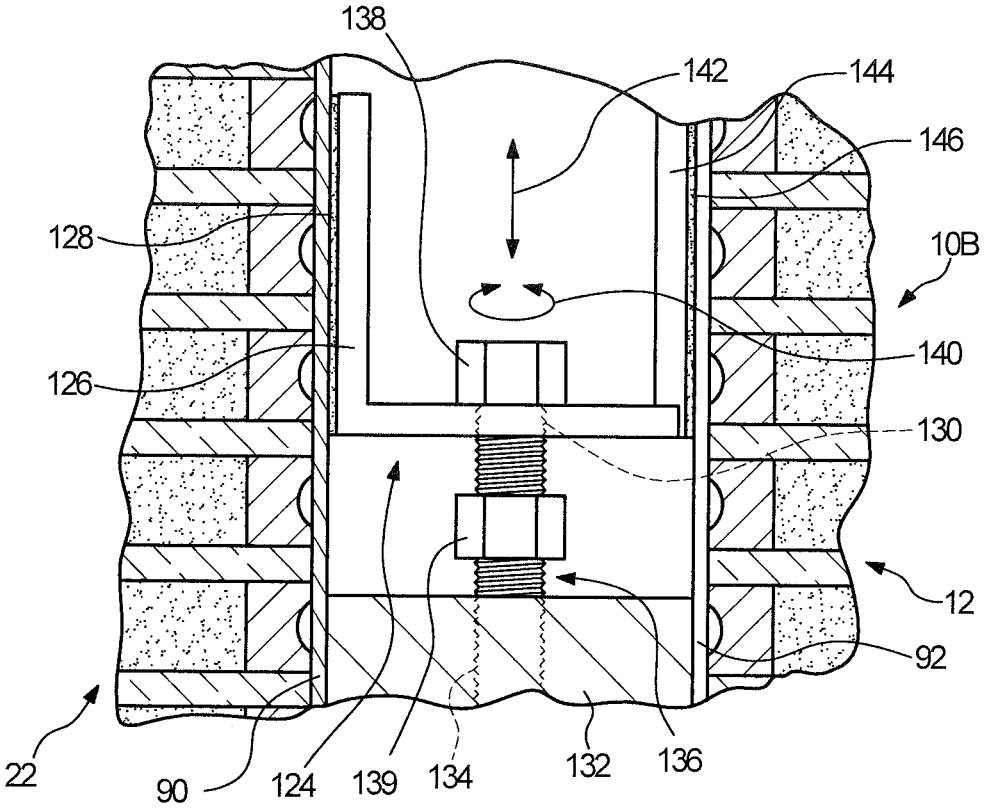
FIG. 5 is a sectional view of yet another embodiment of a framing device for a glass floor.
Figure 6:
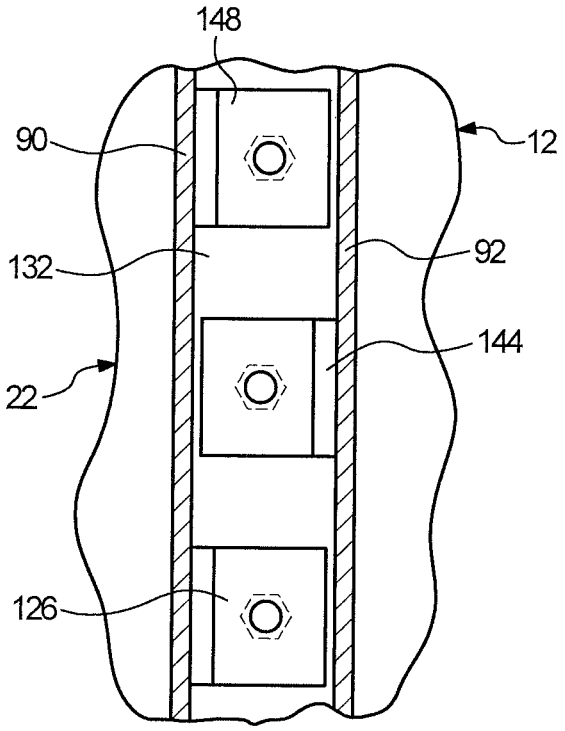
FIG. 6 is a top sectional view of the embodiment of FIG. 5 depicting staggered tabs between adjacent shields.

Referencing now FIGS. 5 and 6, yet another embodiment 10B of the device of the present application is shown. Device 10B is again employed with glass floor units 12 and 22. Device 10B depicts an adjuster 124 which utilizes a tab or clip 126 that is connected to shield 90, attached to glass floor unit 221, shown partially in FIGS. 5 and 6, by a weld 128. Tab 126 includes an opening or aperture 120 therethrough. A steel plate 132 is supported by the flange 40 of beam 38 within concrete post 32 positioned on foundation 36, shown in FIGS. 1 and 2. Steel plate 132 includes a threaded opening 134 which accepts a threaded bolt 136. Head 138 of threaded bolt 136 bears on tab 126. A lock nut 139 is fixed to bolt 136. The turning of bolt head 138, directional arrow 140, will move glass floor unit up or down relative to steel plate 132 and foundation 36, directional arrow 142. It should be noted that a tab 144 is connected at weld 146 to shield 92, connected to glass floor unit 12, and operates in the same manner as tab 126, by the use of an adjuster similar to adjuster 124. FIG. 6 depicts the staggering of tabs 126, 144, and 148 between shield 90 of glass floor unit 22 and shield 92 of glass floor unit 12.

Viewing now FIGS. 7-11, another embodiment 10C of the framing device for a fire-rated glass floor is shown. Glass floor units 150 and 512 are depicted schematically. It should be understood that glass floor units 150 and 152 are similar to glass floor units 12 and 22 of FIG. 2. Glass floor units 150 and 152 include connected shields 154 and 156, which are similar to shields 90 and 92 of FIG. 4. Shields 154 and 156 are connected to glass floor units 150 and 152 by mastic layers 151 and 153, respectively. A support 158 is similar to support 20 of FIG. 1 and may take the form of a metallic member or plate which sits atop a beam (note shown) similar to beam 38 of FIG. 1. Embodiment 10C includes a plurality of tabs 160 in the form of L-shaped members. Tabs 162, 164, and 166 are welded to shield 154. Likewise, tabs 168 and 170 are welded to shield 156. It should be understood that plurality of tabs 160 are not limited to the number depicted in FIG. 7.

Figure 8:
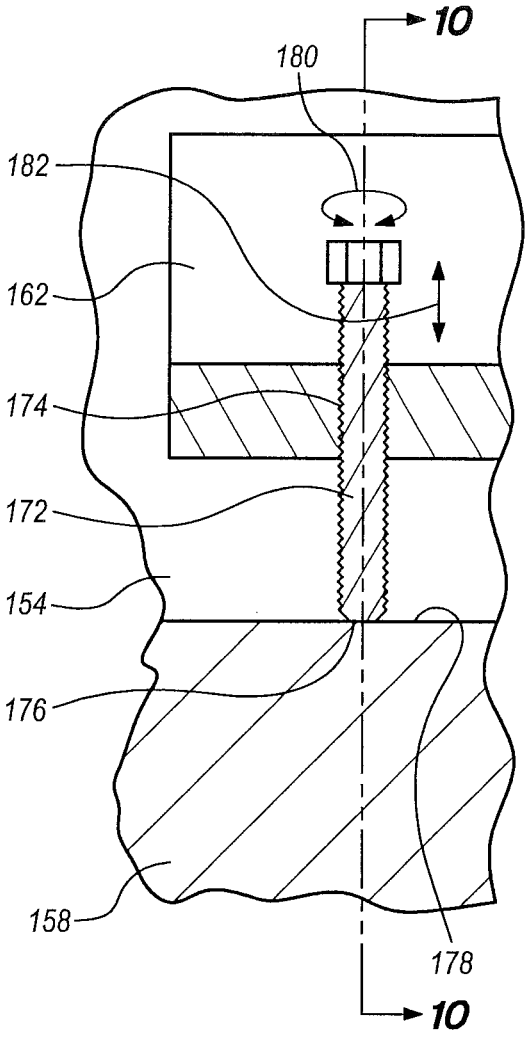
FIG. 8 is a sectional view taken along line 8-8 of FIG. 7.

With reference now to FIG. 8, it may be observed that tab 162 is shown and includes a threaded bolt 172 that threadingly engages a tapped opening 174 through L-shaped tab 162. The bottom surface 176 of threaded bolt 172 bears on the upper surface 178 of support 158. Thus, the turning of threaded bolt 172, directional arrow 180, moves tab 162, shield 154, and connected glass floor unit 150 up or down according to directional arrow 182. It should be realized that tabs 166, and 168 operate in the same manner. Needless to say, tab 168, of course, being welded to shield 156, moves connected glass floor unit 152 up or down in the same manner as heretofore described with respect to tab 162.

Figure 7:
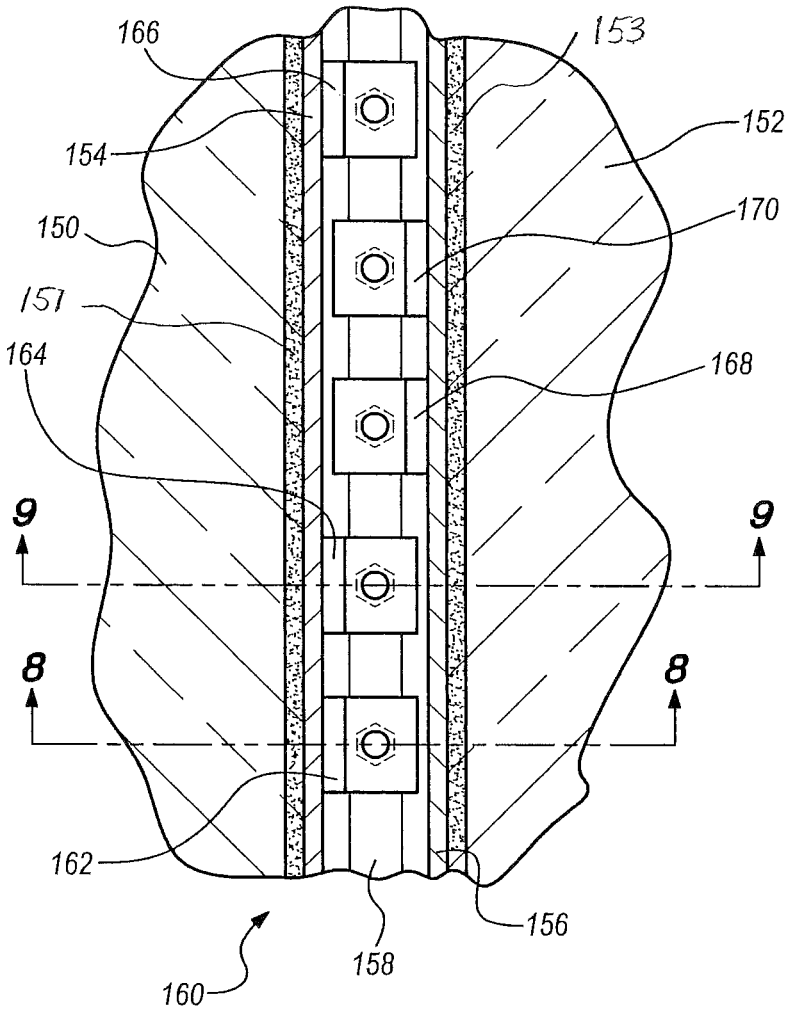
FIG. 7 is a top plan view with the shields in section depicting yet another embodiment of the framing device of the present application.
Figure 9:
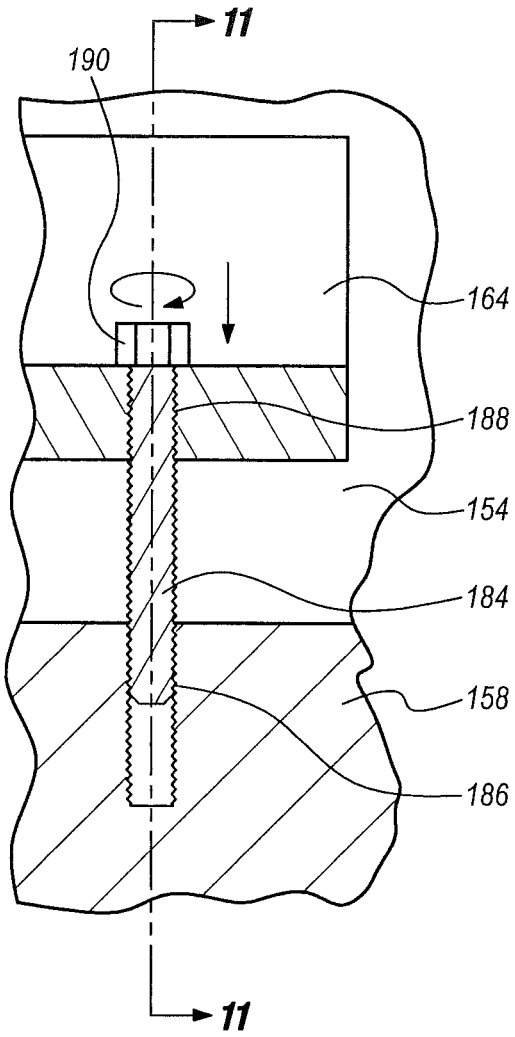
FIG. 9 is a sectional view taken along line 9-9 of FIG. 7.
Figure 10:
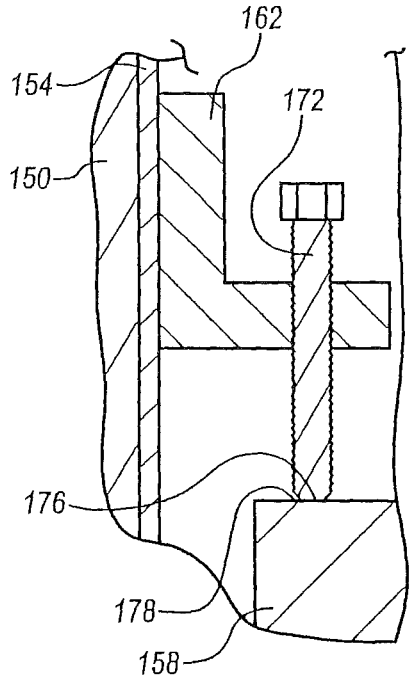
FIG. 10 is a sectional view taken along line 10-10 of FIG. 8.
Figure 11:
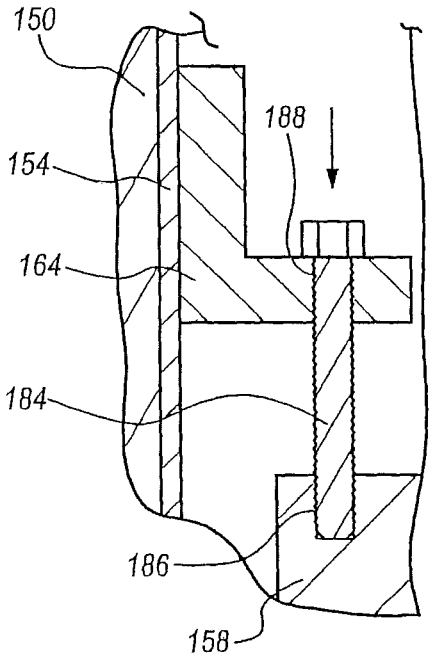
FIG. 11 is a sectional view taken along line 11-11 of FIG. 9.

Looking at FIG. 9, it may be seen that tab 164 includes a threaded bolt 184 that engages a tapped opening 186 in support 158. Opening 188 through L-shaped tab 164 is untapped allowing bolt head 190 to bear on tab 164 and permits tab 164 to serve as a hold down of shield 154 and attached glass floor unit 150. Again, tab 164 operates in the same manner as tab 170 welded to shield 156 associated with glass floor unit 152. Plurality of tabs 160 are staggered across support 158, as shown in FIG. 7. FIG. 10 depicts tab 162 welded to shield 154. Likewise, FIG. 11 shows tab 164 welded to shield 154.

Figure 12:
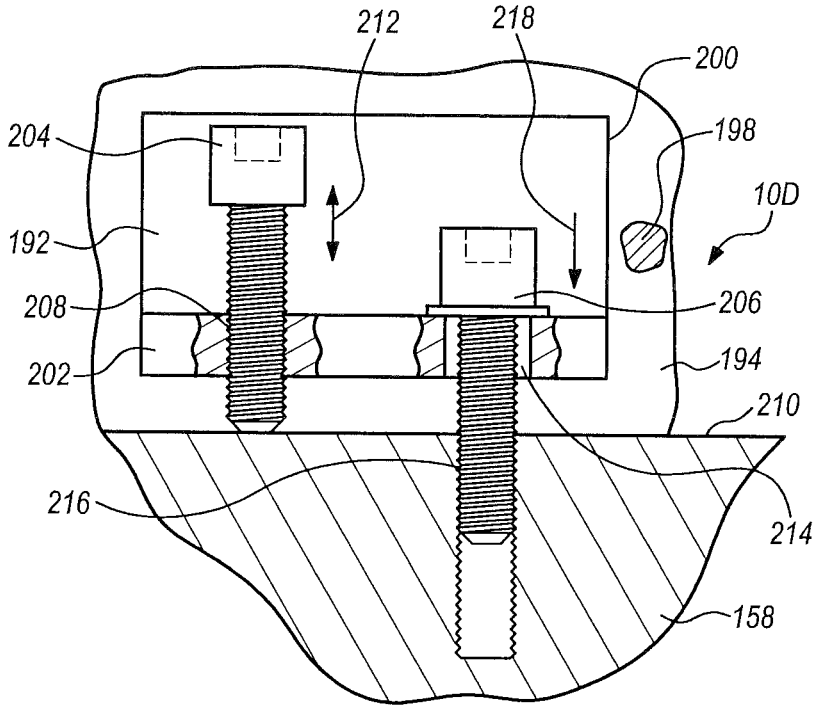
FIG. 12 is a side view of another embodiment of a framing device for a glass floor.
Figure 13:
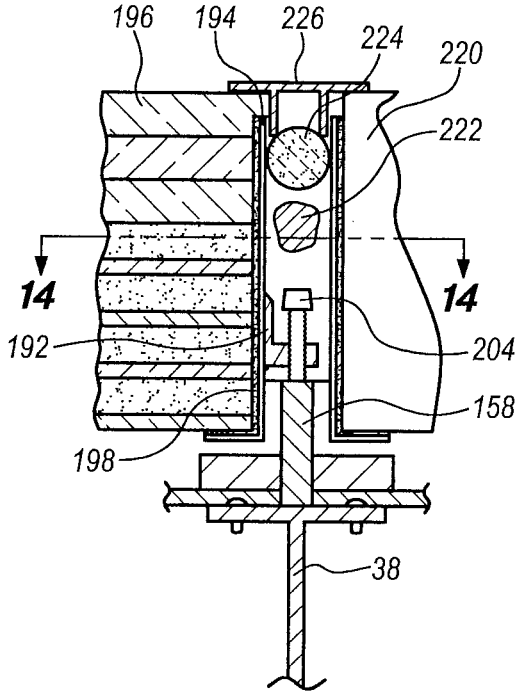
FIG. 13 is a side view, partially in section of the tab shown in FIG. 12 in place between a pair of glass floor units.
Figure 14:
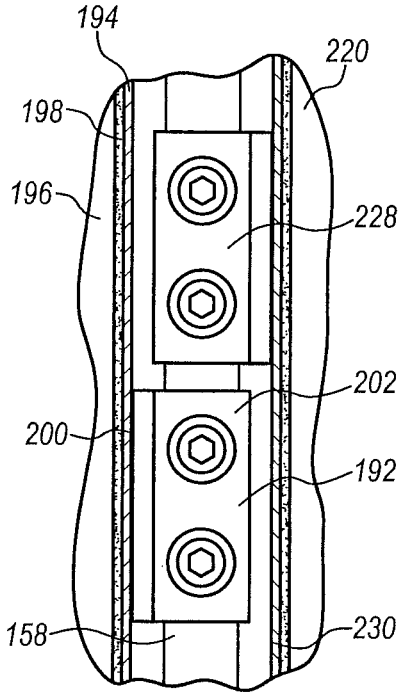
FIG. 14 is a sectional view taken along line 14-14 of FIG. 13.

Referring now to FIGS. 12-14, another embodiment 10D is depicted. FIG. 12 shows a tab 192 which is welded to a metallic shield 194 held to a glass floor unit 196 by a mastic layer 198, FIGS. 13 and 14. Tab 192 is welded to shield 194 along weld line 200, FIGS. 12-14. Tab 192 includes a shelf 202 which accepts Allen head bolts 204 and 206. A tapped opening 208 extends through shelf 202 and allows Allen head bolt 204 to threadingly engage tapped opening 208 and to bear on the upper surface 210 of support 158. Thus, the turning of Allen head bolt 204 will raise and lower shield 194 and connected glass floor unit 196, according to directional arrow 212. Also, shelf 202 of tab 192 possesses an aperture 214 which extends through shelf 202. Allen head bolt 206 is thus able to engage a threaded opening 216 in support 158, which functions as a hold-down for shield 194 and connected glass floor unit 196, according to directional arrow 218. It should be seen that the space between glass floor unit 196 and glass floor unit 220 (shown schematically in FIGS. 13 and 14) is filled with caulking 222 and foam rod 224. A cap 226 encloses caulking 222 and foam rod 224. FIG. 14 illustrates the positioning of tab 192 and a similar tab 228 between shields 194 and 230 associated with and connected to glass floor units 196 and 220, respectively. Tab 228 is welded to shield 230 in a similar manner that tab 192 is welded to shield 194. Tab 192 and 228 are staggered along support 158 between glass floor units 196 and 220.

Figure 15:
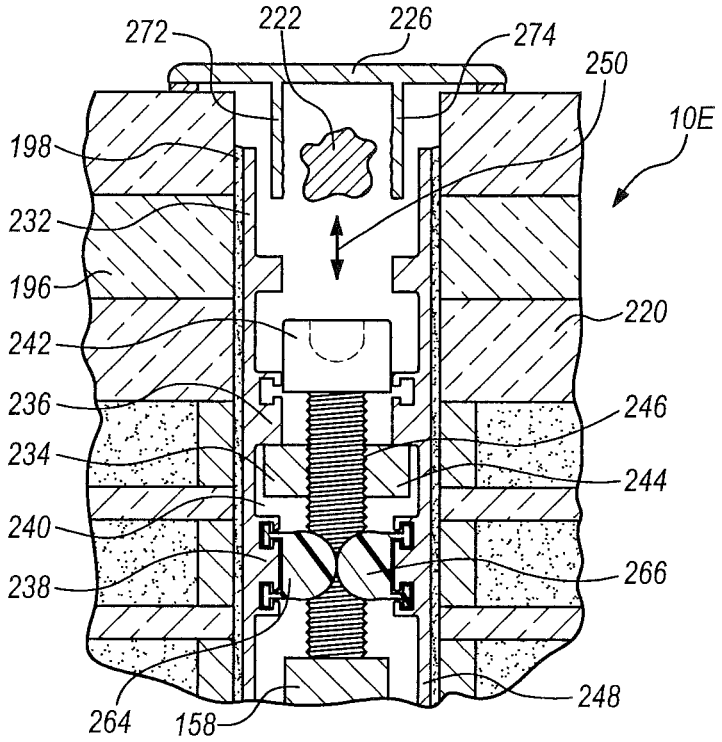
FIG. 15 is a sectional view showing another embodiment of a framing device for a glass floor.
Figure 16:
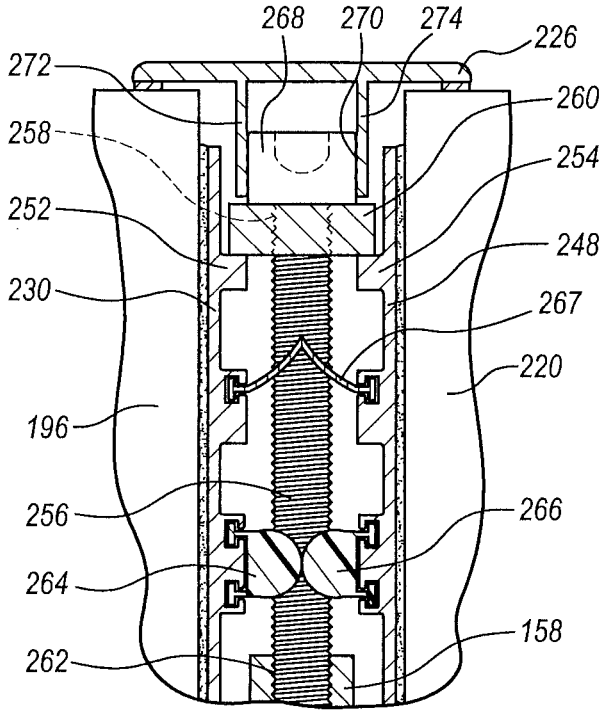
FIG. 16 is a sectional view showing the embodiment illustrated in FIG. 15.

FIGS. 15 and 16 illustrate yet another embodiment 10E of the glass floor unit device of the present application. As shown, the glass floor unit and shields depicted in FIGS. 12-14 are again shown in FIGS. 15 and 16 and bear identical reference characters. A shield 232 is held and connected to glass floor unit 196 by mastic layer 198. Shield 232 is formed with protrusions 236 and 238 which form a recess 240, therebetween. A plate 244 is held within the recess 240 by welding the same to a shield 232. Plate 244 includes a tapped or threaded opening 246. Allen head bolt 242 threadingly engages tapped opening of plate 244 and bears on support 158 allowing Allen head bolt to adjust the up and down movement of shield 230 and connected glass floor unit 196, according to directional arrow 250. Similarly, shield 248, fashioned as a mirror image of shield 230, allows the up and down adjustment of shield 248 and connected glass floor unit 220, directional arrow 250. Turning now to FIG. 16, shields 230 and 248 connected to glass floor units 196 and 220, respectively, also include lips 252 and 254, respectively. Allen head bolt 256 passes through an aperture 258 of plate 260 and engages a threaded or tapped opening 262 in support 158. Thus, FIG. 16 illustrates a hold-down of glass floor units 196 and 220 via shields 230 and 248. Gaskets 264 and 266 are intended to control moisture in the space between glass floor units 196 and 220. Gasket 268, FIG. 16, is also employed to control the flow of moisture between glass floor units 196 and 220. It should also be apparent that Allen head bolt 256 includes a head 268 with a serrated circumference 270. Serrated circumference 270 engages serrated surfaced legs 272 and 274 of cap 226 for the purpose of stabilization of Allen head bolt 256.

Figure 17:
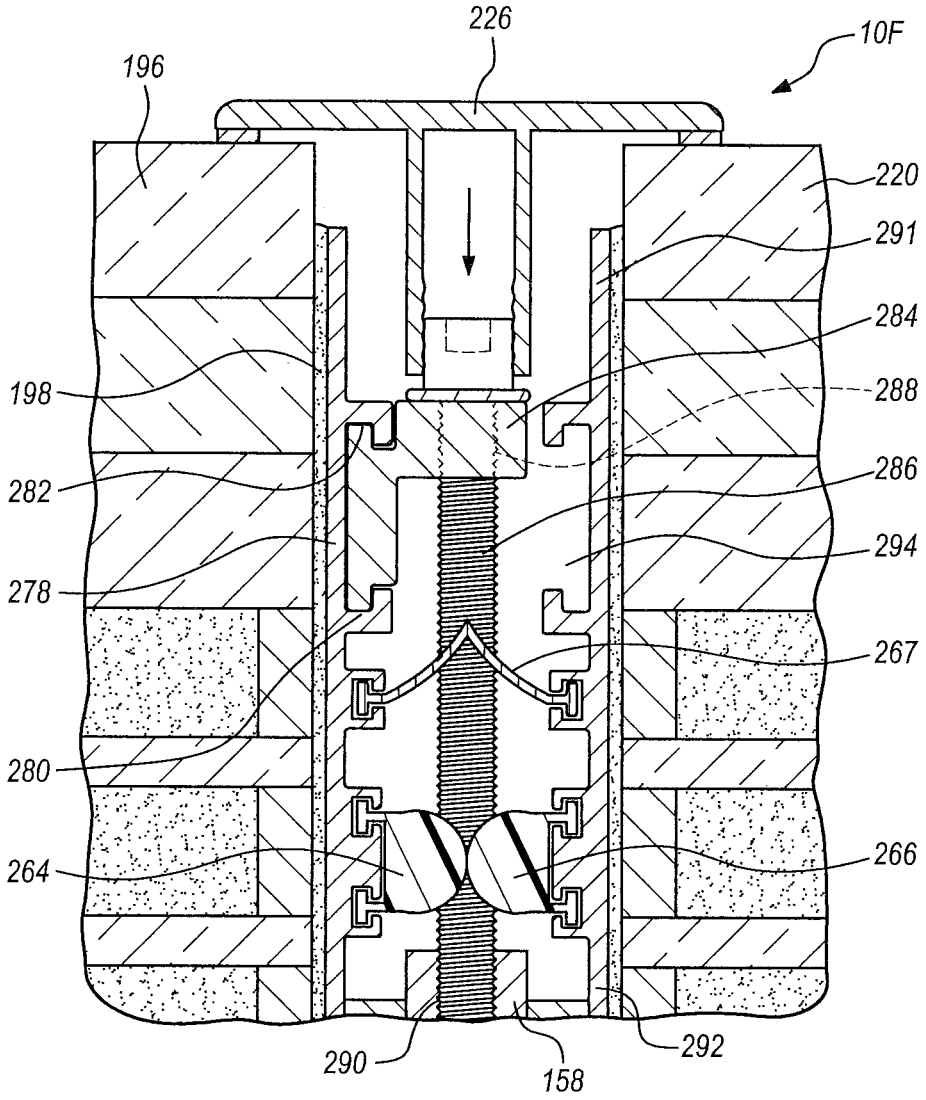
FIG. 17 is a sectional view showing another embodiment of a framing device for a glass floor.

Looking now at FIG. 17, embodiment 10F of the present application is revealed. Embodiment 10F possesses many of the common elements shown in FIGS. 12-16 and are appropriately identified with common reference characters. Shield 278 is attached to glass floor unit 196 by mastic layer 198 and is formed with an extension 280 or protrusion 280 having a slot 282. An L-shaped extrusion 284 slidingly engages slot 282 and forms a support for Allen head bolt 286. An aperture 288 through L-shaped extrusion 284 positions Allen head bolt 286 into threading engagement with a threaded opening 290 in support 158. Thus, the embodiment depicted in FIG. 17 serves as a hold-down for glass floor unit 196. Shield 291, connected to glass floor unit 220, is shown as a mirror image of shield 278 and, thus, includes a slot 194 for an L-shaped extrusion similar to extrusion 284 and a bolt similar to bolt 286 which would then function as a hold-down for glass floor unit 220.

In operation, the framing device for a fire-rated glass floor of embodiment 10C is operated by utilizing the threaded bolts associated with each of the plurality of tabs 160. For example, in FIG. 8, threaded bolt 172 is turned and engages threaded or tapped opening 174 at tab 162 such that the bottom of threaded bolt 172 bears on the upper surface 178 of support 158. Thus, shield 154 welded to tab 162 moves glass floor unit 150 up or down as desired. Similarly, with respect to FIG. 9, it may be observed that tab 164 includes a threaded bolt 184 that engages a tapped opening 186 of support 158 and serves as a hold down such that the bolt head 190 of threaded bolt 184 bears on tab 164. Again, tabs 162, 168, and 166 operate as position adjusters, while tabs 164 and 167 serve as hold downs.

While in the foregoing embodiments of the application have been set forth in considerable detail for the purposes of making a complete disclosure of the invention, it may be apparent to those of skill in the art that numerous changes may be made in such detail without departing from the spirit and principles of the application.

What is claimed is:

1. A framing device for a floor structure positioned on foundation, comprising:

a glass floor unit, said glass floor unit comprising a durable glass portion, including a walking surface, an undersurface, and a side surface located intermediate said walking surface and said undersurface, and a connected fire-rated glass portion, said fire-rated glass portion including a side surface and an undersurface adjacent said side surface;

a support for said glass floor unit, said support linked to the foundation;

a shield, said shield being fixed to said glass floor unit by a connector for movement of the shield, floor unit, and connector as a whole, said shield being formed of a rigid or semi-rigid material, said shield comprising one part overlying said side surface of said durable glass portion of said glass floor unit and another part overlying said side surface of said fire-rated glass portion and overlying said undersurface of said fire-rated glass portion of said glass floor unit;

one tab connected to said shield, said one tab including a tapped opening therethrough; and a threaded member, said threaded member threadingly engaging said tapped opening of said one tab and engaging said support and an adjuster for moving said glass floor unit relative to the foundation, said adjuster comprising said threaded member being turnable relative to said tab and said connected shield.

2. The device of claim 1 which additionally comprises another tab and a mechanism for holding said another tab relative to said support.

3. The device of claim 1 in which said one tab further comprises an aperture therethrough and said support comprises a tapped opening and said threaded member comprises a first threaded member and further comprises a second threaded member, said second threaded member passing through said aperture and threadingly engaging said tapped opening in said support.

4. The device of claim 1 in which said shield comprises a first shield and which further comprises a second shield, and said glass floor unit comprises a first glass floor unit and further comprises a second glass floor unit, said second shield being connected to said second glass floor unit in facing configuration relative to said first shield, said another tab being connected to said second shield.

5. The device of claim 4 in which said one and another tabs are staggered from one another along a dimension of said first and second shields.

6. The device of claim 1 in which said shield comprises a stainless steel shield.

7. The device of claim 1 in which said shield comprises a copper shield.

8. The device of claim 1 in which said connector comprises a mastic layer between said shield and said glass floor unit.

9. The device of claim 1 in which said one tab connected to said shield is welded to said shield.

* * * * *